US005350061A

United States Patent [19]

Gunn

[11] Patent Number: 5,350,061

[45] Date of Patent: Sep. 27, 1994

[54] CONTAINER SYSTEMS FOR SCHOOL SUPPLIES

[76] Inventor: Andrew L. Gunn, 2829 Ransom Island Dr., Corpus Christi, Tex. 78418

[21] Appl. No.: 183,871

[22] Filed: Jan. 21, 1994

[51] Int. Cl.[5] ..... A45C 11/34; B65D 85/28

[52] U.S. Cl. ..... 206/214; 206/425; 206/371; 220/23.4; 281/38

[58] Field of Search ..... 206/214, 215, 576, 371, 206/425, 1.7, 503, 504, 508, 511; 229/1.5 R; 281/38, 30, 31, 34, 35; 220/23.2, 23.4, 23.6

[56] References Cited

U.S. PATENT DOCUMENTS

| | | | |
|---|---|---|---|
| 868,835 | 10/1907 | Bexell | 229/1.5 R |
| 1,495,953 | 5/1924 | Dick | 229/1.5 R |
| 3,727,823 | 4/1973 | Sullivan | 206/215 X |
| 4,130,197 | 12/1978 | Fox | 206/425 X |
| 4,852,740 | 8/1989 | Sellas et al. | 281/31 X |
| 4,884,691 | 12/1989 | Behrens et al. | 206/425 X |
| 4,911,303 | 3/1990 | Andersson | 206/511 X |
| 5,058,736 | 10/1991 | Bedol | 206/214 |
| 5,087,145 | 2/1992 | Cooley | 281/38 X |
| 5,186,345 | 2/1993 | Chiang An | 220/23.4 |

*Primary Examiner*—Jacob K. Ackun, Jr.
*Attorney, Agent, or Firm*—Michael J. Colitz, Jr.

[57] ABSTRACT

A container system for school supplies comprising a container having long parallel side walls and short parallel end walls coupled together in a rectangular configuration with a rectangular floor secured at its periphery to the adjacent edges of the side and end walls, a lid in a planar configuration positionable over the edges of the side and end walls remote from the floor, a hinge coupling the adjacent edges of the container and lid for opening and closing the container, a clasp to secure the lid in a closed position with respect to the container, a flexible tab formed as an extension of the floor, the tab having a plurality of apertures for being received within the loose leaf note book of a student and a plurality of planar strips secured along their interior edges to the face of the floor within the container and with their end edges secured with respect to the side and end walls to thereby form a plurality of compartments for the segregated receipt of school supplies.

3 Claims, 4 Drawing Sheets

CONTAINER SYSTEMS FOR SCHOOL SUPPLIES

BACKGROUND OF THE INVENTION

1. Field of the Invention

The present invention relates to container systems for school supplies and more particularly pertains to storing school supplies in containers positionable within loose leaf binders.

2. Description of the Prior Art

The use of school supply containers is known in the prior art. More specifically, school supply containers heretofore devised and utilized for the purpose of storing supplies for use in school are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,136,773 to Booth discloses a container for artists crayons.

U.S. Pat. No. 4,176,743 to Fitzpatrick discloses a portable desk top tray.

U.S. Pat. No. 4,304,330 to Winkler et al discloses a case for writing utensils.

U.S. Pat. No. 4,555,018 to Cho discloses a portable folder type pencil case.

Lastly, U.S. Pat. No. 4,573,571 to Leem discloses a pencil case.

In this respect, the container systems for school supplies according to the present invention substantially departs from the conventional concepts and designs of the prior art, and in doing so provides an apparatus primarily developed for the purpose of storing school supplies in containers positionable within loose leaf binders.

Therefore, it can be appreciated that there exists a continuing need for new and improved container systems for school supplies which can be used for storing school supplies in containers positionable within loose leaf binders. In this regard, the present invention substantially fulfills this need.

SUMMARY OF THE INVENTION

In view of the foregoing disadvantages inherent in the known types of school supply containers now present in the prior art, the present invention provides an improved container systems for school supplies. As such, the general purpose of the present invention, which will be described subsequently in greater detail, is to provide a new and improved container systems for school supplies and method which has all the advantages of the prior art and none of the disadvantages.

To attain this, the present invention essentially comprises a new and improved container system for school supplies comprising in combination a container having long parallel side walls and short parallel end walls coupled together in a rectangular configuration with a rectangular floor secured at its periphery to the adjacent edges of the side and end walls, a lid in a planar configuration positionable over the edges of the side and end walls remote from the floor, a hinge coupling the adjacent edges of the container and lid for opening and closing the container, a clasp to secure the lid in a closed position with respect to the container, a flexible tab formed as an extension of the floor, the tab having a plurality of apertures for being received within the loose leaf note book of a student, a plurality of planar strips secured along their interior edges to the face of the floor within the container and with their end edges secured with respect to the side and end walls to thereby form a plurality of compartments for the segregated receipt of school supplies, a supplemental container of a configuration similar to that of the first mentioned container, a plurality of apertures extending through the floor of the first mentioned container and a plurality of pins extending from the exterior surface of the floor of the supplemental container and releasably positionable within the holes to thereby form a system with two container releasably secured with respect to each other and a pivot rod extending through at least one of the containers through a plurality of the compartments, the pivot rod including lifter fingers extending radially from the pivot rod with means exterior of the container to pivot the rod and fingers for the partial lifting of school supplies from their associated compartments.

There has thus been outlined, rather broadly, the more important features of the invention in order that the detailed description thereof that follows may be better understood and order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved container systems for school supplies which have all the advantages of the prior art school supply containers and none of the disadvantages.

It is another object of the present invention to provide new and improved container systems for school supplies which may be easily and efficiently manufactured and marketed.

It is further object of the present invention to provide new and improved container systems for school supplies which are of durable and reliable constructions.

An even further object of the present invention is to provide new and improved container systems for school supplies which are susceptible of a low cost of manufacture with regard to both materials and labor, and which accordingly are then susceptible of low prices of sale to the consuming public, thereby making such container systems for school supplies economically available to the buying public.

Still yet another object of the present invention is to provide new and improved container systems for school supplies which provide in the apparatuses and methods of the prior art some of the advantages thereof, while simultaneously overcoming some of the disadvantages normally associated therewith.

Even still another object of the present invention is to store school supplies in containers positionable within loose leaf binders.

Lastly, it is an object of the present invention to provide new and improved container systems for school supplies comprising a container having long parallel side walls and short parallel end walls coupled together in a rectangular configuration with a rectangular floor secured at its periphery to the adjacent edges of the side and end walls, a lid in a planar configuration positionable over the edges of the side and end walls remote from the floor, a hinge coupling the adjacent edges of the container and lid for opening and closing the container, a clasp to secure the lid in a closed position with respect to the container, a flexible tab formed as an extension of the floor, the tab having a plurality of apertures for being received within the loose leaf note book of a student and a plurality of planar strips secured along their interior edges to the face of the floor within the container and with their end edges secured with respect to the side and end walls to thereby form a plurality of compartments for the segregated receipt of school supplies.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
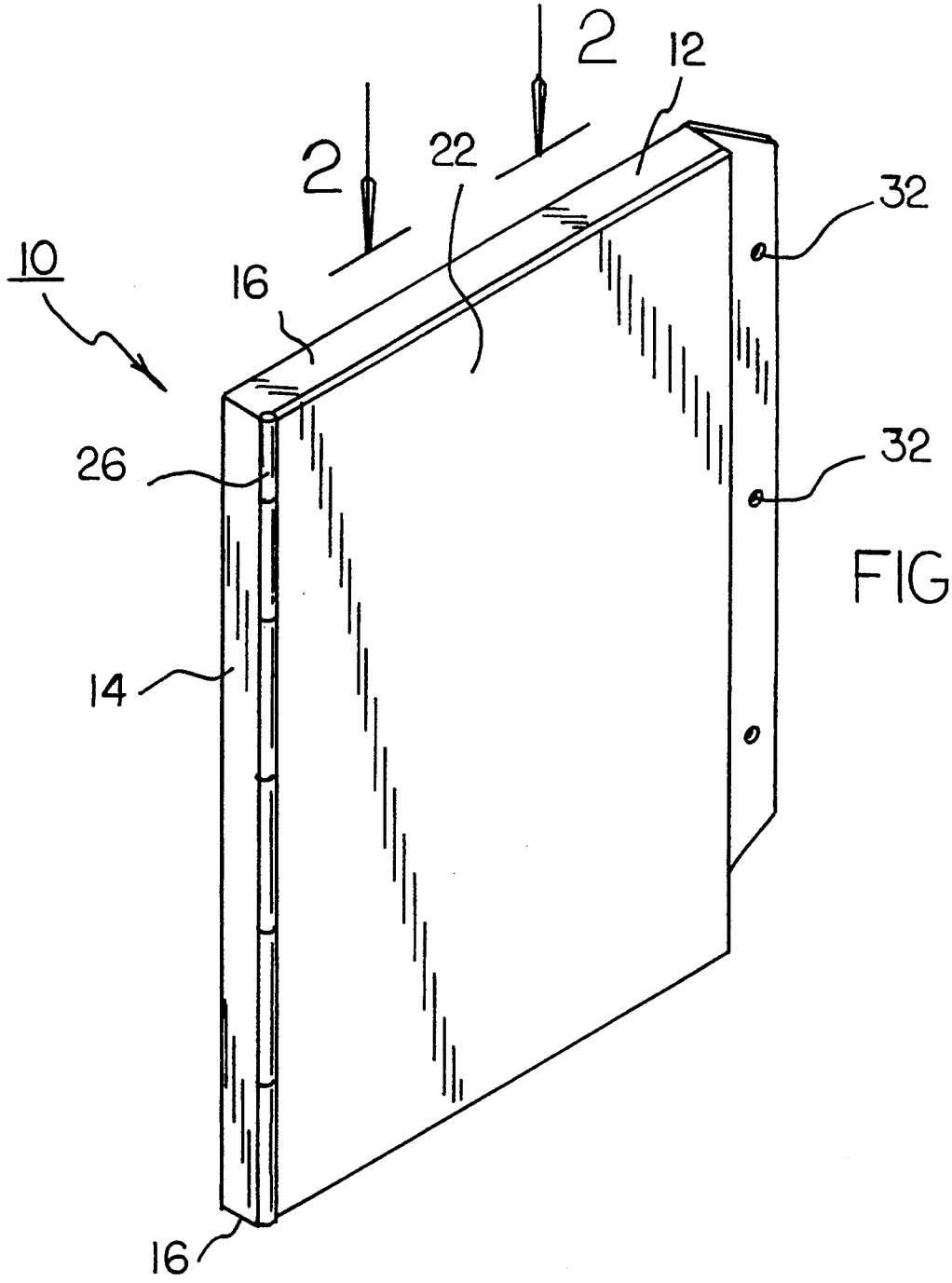
FIG. 1 is a perspective view of the preferred embodiment of the container systems for school supplies constructed in accordance with the principles of the present invention.
Figure 2:
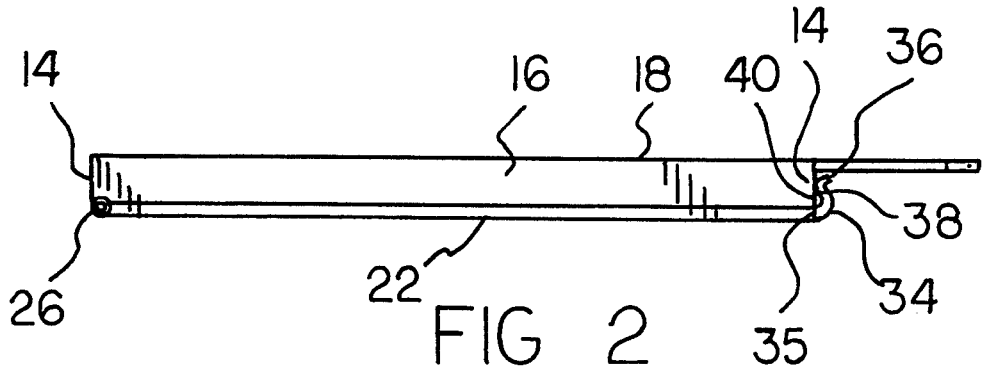
FIG. 2 is a top elevational view taken along line 2—2 of FIG. 1.
Figure 3:
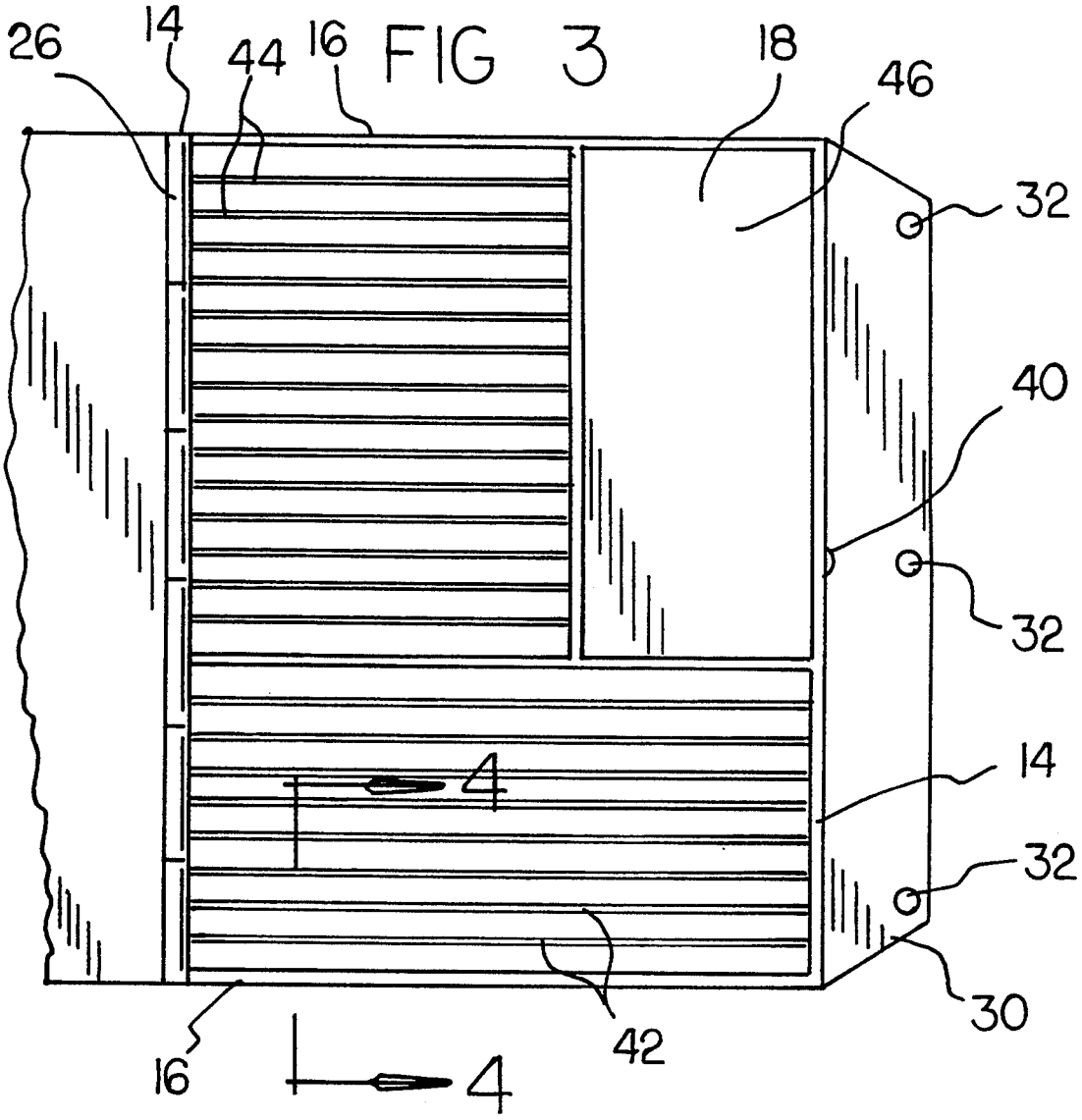
FIG. 3 is a plan view of the device of the prior Figures but in an opened configuration.
Figure 4:
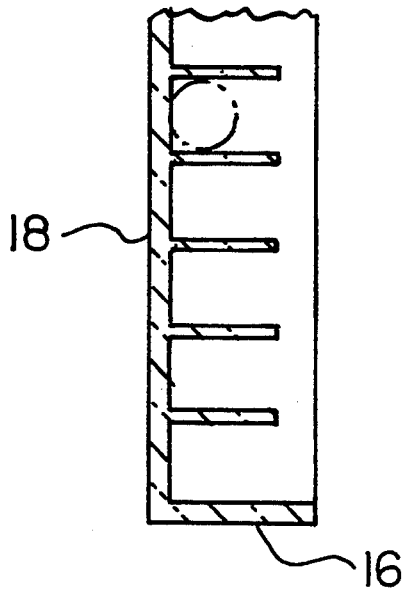
FIG. 4 is a cross sectional view taken along line 4—4 of FIG. 3.

With reference now to the drawings, and in particular to FIG. 1 thereof, the preferred embodiment of the new and improved container systems for school supplies embodying the principles and concepts of the present invention and generally designated by the reference numeral 10 will be described.

The present invention, the new and improved container system for school supplies, includes, in its broadest context, a container, lid, hinge, clasp, flexible tab, and a plurality of strips within the container. The various parts are individually configured and arranged with respect to each other to attain the intended objectives.

More specifically, the system 10 of the present invention has as its main component a container 12. The container 12 has long parallel side walls 14 and short parallel end walls 16. Such walls are connected at their ends into a rectangular configuration. The container 12 also includes a floor 18. The floor 18 is secured at its periphery to the adjacent edges of the side and end walls 14 and 16. The side walls and end walls 14 and 16 may be individually fabricated with respect to the floor 18 or, in the alternative, they may be fabricated as of a rigid plastic into a one-piece configuration.

The next major component of the system 10 is the lid 22. The lid 22 is configured in a planar configuration. It is of a size essentially equal to that of the rectangular floor 18. As a result, the peripheral edges of the lid 22 are adapted to overlie the adjacent edges of the long parallel side walls 14 and the short parallel end walls 16. The edges of these walls are those edges which are remote from the edges in contact with the floor 18. As a result, a rectangular space is formed in the region between the floor 18 and lid 22 and between the side walls 14 and end wall 16.

Coupling the lid 22 and the container 12 is a hinge 26. The hinge 26 is secured against one long edge of the lid 22 and the adjacent edge of one parallel side wall at its adjacent edge. The hinge 26 thus allows the lid 22 to be moved to an opened position for putting contents into the container or for removing contents therefrom. It is also adapted to be moved to a closed position through rotation of the lid 22 about the hinge 26 for closing the container 12 to secure the contents therewithin.

Securement between the container 12 and a loose leaf notebook is effected by a tab 30. The tab 30 is of a length equivalent to the height of the container 12 measured along the long parallel side walls 14. The tab 30 is of a flexible material such as plastic and is provided with a plurality of apertures 32, preferably three. Such three apertures are spaced so as to be received within the rings of a conventional binder. A greater or lesser number of holes could be employed to correspond with a particular type of binder with a like number of holes. The tab 30 is formed in the plane of the floor 18 and extends outwardly thereof on the side opposite from the hinge. This allows the container 12 to be placed in a notebook and to be turned like any other page within the notebook.

In order to provide a secure coupling between the lid 22 and the container 12, there is provided a clasp 34. The clasp 34 includes a rigid member of limited flexibility. It is secured at one end 35 to the lid 22 on an exterior surface thereof at one edge, the edge remote from the hinge 26. The rigid member also has a second end 36. The second end 36 extends at a right angle from the portion thereabove. It extends parallel with the external surface of the adjacent side walls 14. It is formed with a hemispherical dimple 38. The dimple 38 is adapted to releasably couple with respect to a hemispherical projection 40 centrally located along the adjacent side strip. The rigid member has a limited degree of flexibility. As such, the rigid member may be moved into contact with the projection 40 or away therefrom to lock or unlock the lid 22 with respect to the container 12.

The last major component of the system 10 of the primary embodiment is a plurality of strips 42. The strips 42 are of a thin material with an elongated rectangular configuration. Each strip 42 is secured along its interior edge to the face of the floor 18 within the container 12. The strips 42 include elongated strips secured at their ends to the side walls 14 to define elongated compartments for long objects such as pencils and pens. Shorter strips 44 are located parallel with respect to the longer strips 42 to define shorter and smaller compartments for smaller objects such as crayons, erasers, paper clips or the like. In addition, a transverse strip is secured at right angles with respect to the long and short strips 42 and 44. It is coupled at its opposite ends to an end wall 16 and an intermediate long strip 42. The short strips 44 are coupled thereto along one edge. This defines an enlarged compartment 46 for the storage of other miscellaneous articles which are incapable of fitting into the long compartments or short compartments 46.

Figure 5:
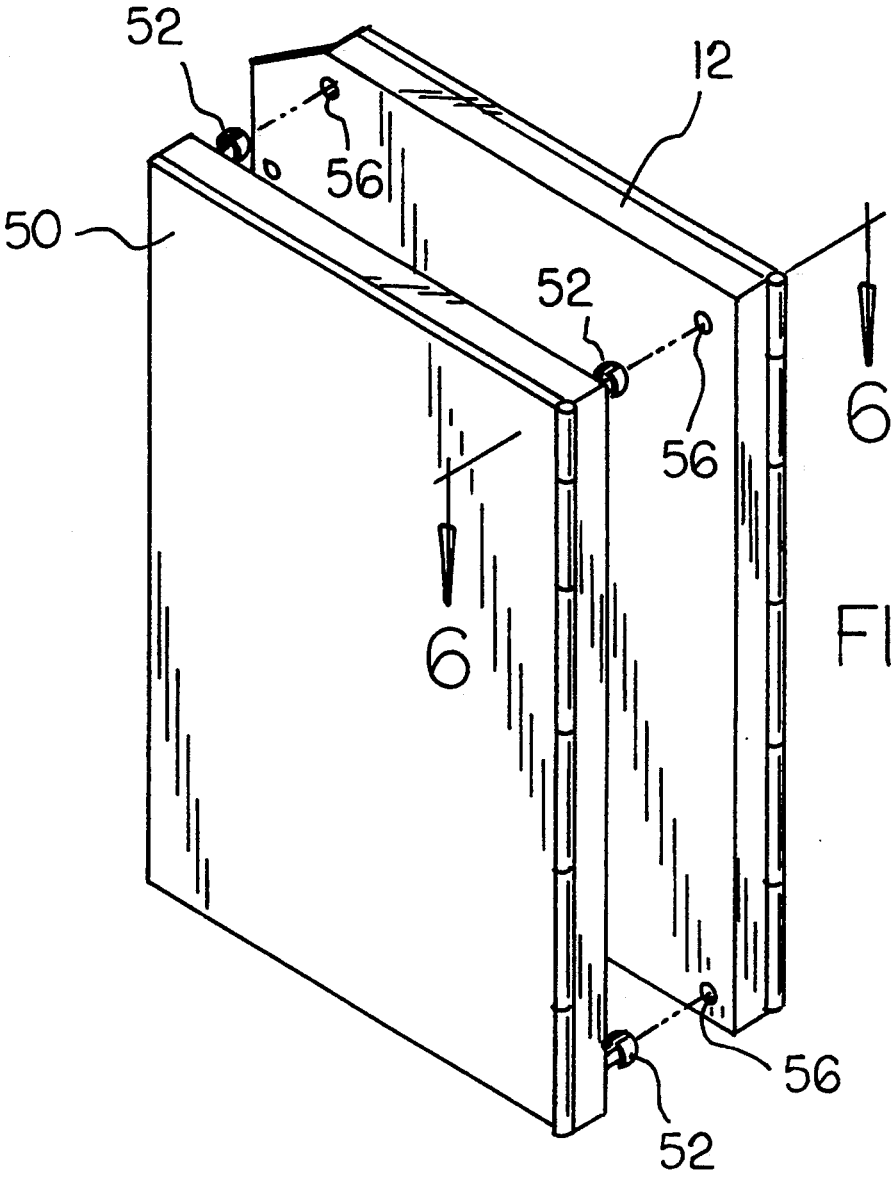
FIG. 5 is a device similar to the prior Figures but constructed in accordance with an alternate embodiment of the invention.
Figure 6:
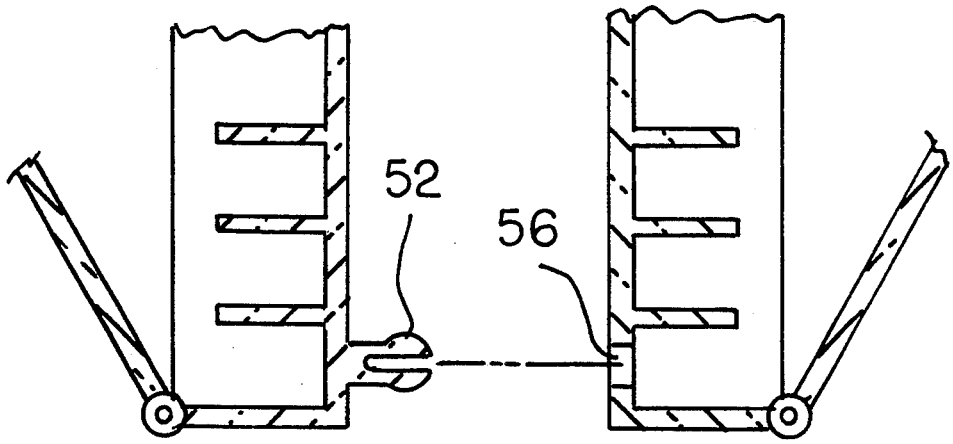
FIG. 6 is a cross sectional view taken along line 6—6 of FIG. 5.

An alternate embodiment of the invention is shown in FIGS. 5 and 6. In such embodiment, there is provided a supplemental container 50 similar to the container 12 of the prior described embodiment. Such container 50 has the other components as in the prior embodiment including the lid 22, hinge 26, clasp 30 and planar strips 44. In addition, the supplemental container 50 is provided with a plurality of flexible pins 52 extending at right angles outwardly from the exterior surface of the floor. Such pins 52 are preferably located adjacent to the four corners thereof. Such pins 52 are adapted to be in cooperative association with similarly shaped circular apertures 56 provided through the floor 18 of the first mentioned container 12. Such apertures 56 are located adjacent to the four corners of the floor 18. In this manner, when the exterior surface of the floor 18 of the two containers are brought into contact one with another, and the pins 52 inserted into the apertures 56, they will provide a frictional fit which will allow the two containers to be a two-faced container for containing twice the amount of contents as the single container embodiment of FIGS. 1 through 4.

Figure 7:
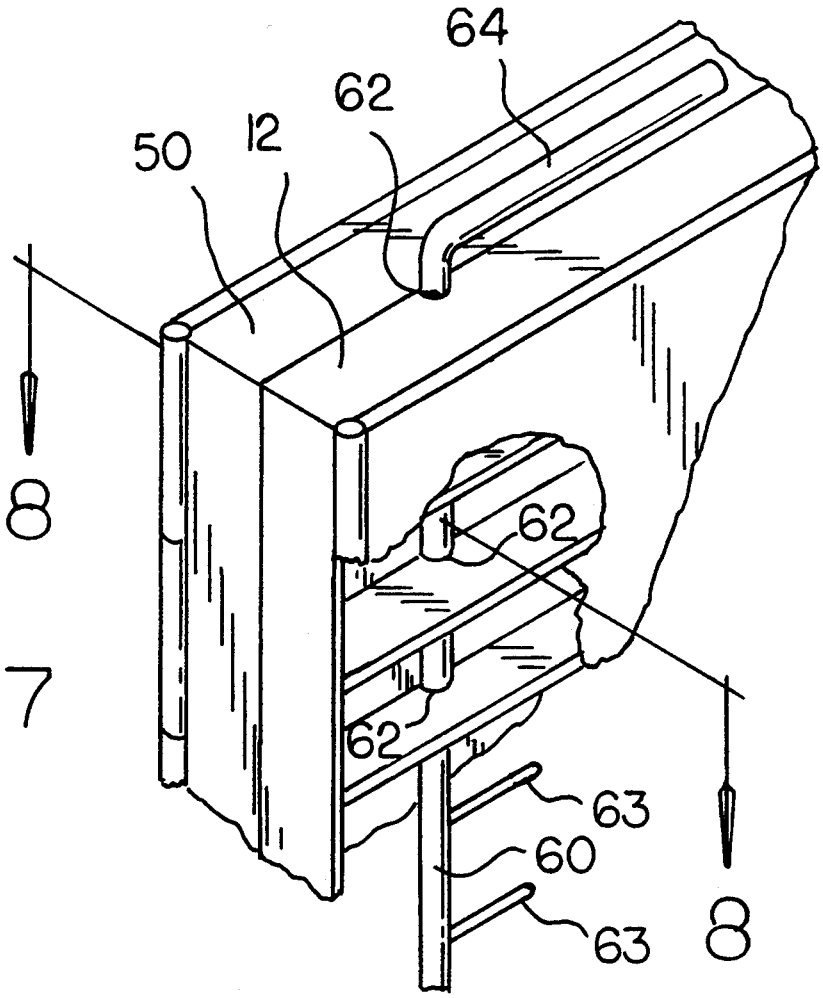
FIG. 7 is an enlarged perspective view of another alternate embodiment of the invention.
Figure 8:
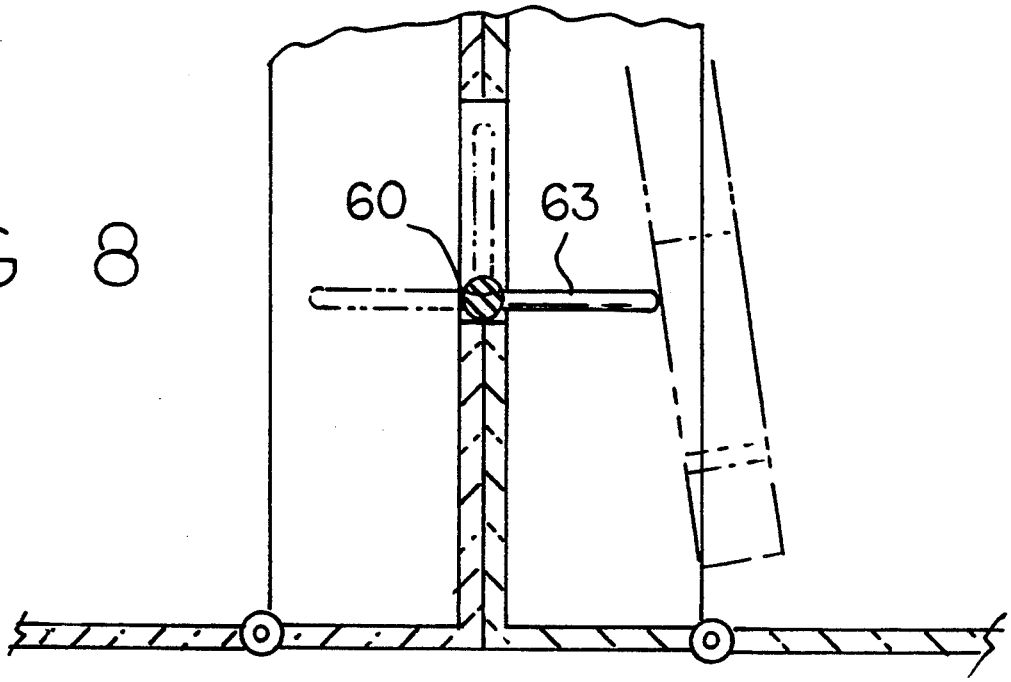
FIG. 8 is a cross sectional view taken along line 8—8 of FIG. 7.

A final embodiment of the invention is shown in FIGS. 7 and 8. In such embodiment, a pivot rod 60 is provided. It extends through holes 62 formed in at least one of the containers. The holes 62 are formed in axial alignment through the end walls 16 adjacent one edge, preferably adjacent the edge with the tab 30. The holes 62 include supplemental holes through the various strips. All of the strips are in axial alignment concurrent with the axis of the pivot rod 60 extending therethrough. The pivot rod 60 includes a plurality of lifter fingers 63. Such lifter fingers 63 extend radially from the pivot rod 60 a short distance and are adapted to be located beneath the article placed in the container 12. At one end of the pivot rod 60 exterior of the container 12 is a handle 64. The handle 64 is adapted to be pivoted to rotate the pivot rod 60 about its axis. Such pivoting causes the lifter fingers 63 to raise from the surface of the floor 18. In doing so, they will lift from the various compartments the articles contained therein for being more easily retrieved by a user. This is to assist the user in removing the school supplies within the compartments from the container 12 more easily.

The present invention is a slim container that is designed to hold such school supplies as crayons, pens, pencils, erasers, etc. It fits in a standard 3-ring binder by means of the three holes that are located in a 1-$\frac{1}{4}$ inch by 10 inch tab that extends along the length of one side. The overall dimensions of the present invention is 10 inches long by 7 inches wide, and is comprised of two main sections, each of which is tray-like and about $\frac{1}{2}$ inch deep. The top section is 6 inches long and has two compartments, each of which are 3-$\frac{1}{2}$ inches wide. A series of individual recesses or slots are integrated into the first compartment to hold crayons, while the other compartment holds necessities such as a compass, eraser, etc. The bottom section is a single compartment that is about 4 inches long, and holds pens, pencils, and markers in individual slots that are configured to accept items of their diameter.

The top or cover of the present invention is hinged for easy retrieval of its contents, and is secured in the closed position by means of a snap-lock device that is integrally molded with male and female connectors. The present invention provides a student the means to organize the usual school supplies in a safe and accessible location. It is made from resilient plastic, and it can be produced in a variety of colors.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved container system for school supplies comprising, in combination:

a container having long parallel side walls and short parallel end walls coupled together in a rectangular configuration with a rectangular floor secured at its periphery to the adjacent edges of the side and end walls;

a lid in a planar configuration positionable over the edges of the side and end walls remote from the floor;

a hinge coupling the adjacent edges of the container and lid for opening and closing the container;

a clasp to secure the lid in a closed position with respect to the container;

a flexible tab formed as an extension of the floor, the tab having a plurality of apertures for being received within the loose leaf note book of a student;

a plurality of planar strips secured along their interior edges to the face of the floor within the container and with their end edges secured with respect to the side and end walls to thereby form a plurality of compartments for the segregated receipt of school supplies;

a supplemental container of a configuration similar to that of the first mentioned container;

a plurality of apertures extending through the floor of the first mentioned container and a plurality of pins extending from the exterior surface of the floor of the supplemental container and releasably positionable within the holes to thereby form a system with two containers releasably secured with respect to each other; and a pivot rod extending through at least one of the containers through a plurality of the compartments, the pivot rod including lifter fingers extending radially from the pivot rod with means exterior of the container to pivot the rod and fingers for the partial lifting of school supplies from their associated compartments.

2. A container system for school supplies comprising:

a container having long parallel side walls and short parallel end walls coupled together in a rectangular configuration with a rectangular floor secured at its periphery to the adjacent edges of the side and end walls;

a lid in a planar configuration positionable over the edges of the side and end walls remote from the floor;

a hinge coupling the adjacent edges of the container and lid for opening and closing the container;

a clasp to secure the lid in a closed position with respect to the container;

a flexible tab formed as an extension of the floor, the tab having a plurality of apertures for being received within the loose leaf note book of a student; and a plurality of planar strips secured along their interior edges to the face of the floor within the container and with their end edges secured with respect to the side and end walls to thereby form a plurality of compartments for the segregated receipt of school supplies; and a supplemental container of a configuration similar to that of the first mentioned container; and a plurality of apertures extending through the floor of the first mentioned container and a plurality of pins extending from the exterior surface of the floor of the supplemental container and releasably positionable within the holes to thereby form a system with two containers releasably secured with respect to each other.

3. The container system as set forth in claim 2 and further including:

a pivot rod extending through the container through a plurality of the compartments, the pivot rod including lifter fingers extending radially from the pivot rod with means exterior of the container to pivot the rod and fingers for the partial lifting of school supplies from their associated compartments.

* * * * *